US005753315A

United States Patent [19]

Minoura et al.

[11] Patent Number: 5,753,315

[45] Date of Patent: May 19, 1998

[54] ELECTROSTATIC COATING METHOD

[75] Inventors: Shuji Minoura; Daisuke Nakazono; Kazuo Nakagawa, all of Sayama, Japan

[73] Assignee: Honda Giken Kogyo Kabushiki Kaisha, Tokyo, Japan

[21] Appl. No.: 722,498

[22] Filed: Sep. 27, 1996

[30] Foreign Application Priority Data

Sep. 29, 1995 [JP] Japan ..... 7-253038

[51] Int. Cl.[6] ..... B05D 1/04; B05D 1/06

[52] U.S. Cl. ..... 427/475; 427/483; 427/484; 427/485

[58] Field of Search ..... 427/466, 467, 427/469, 475, 476, 483, 484, 485; 118/621, 627

[56] References Cited

U.S. PATENT DOCUMENTS

| | | | |
|---|---|---|---|
| 3,900,000 | 8/1975 | Gallen | 118/630 |
| 4,343,828 | 8/1982 | Smead et al. . | |
| 4,826,703 | 5/1989 | Kisler | 427/14.1 |
| 5,135,773 | 8/1992 | Suzuki | 427/13 |
| 5,378,505 | 1/1995 | Kubota et al. | 427/484 |
| 5,503,880 | 4/1996 | Matschke | 427/475 |

*Primary Examiner*—Shrive Beck
*Assistant Examiner*—Fred J. Parker
*Attorney, Agent, or Firm*—Birch, Stewart, Kolasch & Birch, LLP

[57] ABSTRACT

A workpiece is electrostatically coated by an internal-voltage-application-type rotary atomizing electrostatic coating apparatus. An electrically conductive paint is supplied to the internal-voltage-application-type rotary atomizing electrostatic coating apparatus, and a voltage applied to the internal-voltage-application-type rotary atomizing electrostatic coating apparatus is controlled depending on an area of the workpiece which is to be coated, for thereby varying a coated pattern width on the workpiece.

8 Claims, 8 Drawing Sheets

ELECTROSTATIC COATING METHOD

BACKGROUND OF THE INVENTION

1. Field of the Invention:

The present invention relates to a method of supplying a rotary atomizing electrostatic coating apparatus with an electrically conductive paint such as a water-soluble paint, an aqueous paint, or the like to electrostatically coat a workpiece with the electrically conductive paint.

2. Description of the Related Art:

There has heretofore been known an electrostatic coating method which employs a rotary atomizing electrostatic coating apparatus. According to the known electrostatic coating method, an electrically conductive paint such as a water-soluble paint, an aqueous paint, or the like is dropped into a bell-shaped rotor, and atomized from an outer peripheral edge of the bell-shaped rotor under centrifugal forces produced by rotation thereof and electrostatic attractive forces, and the atomized paint is coated on a workpiece due to the potential gradient of an electrostatic field which is developed between the bell-shaped rotor and the workpiece. The electrostatic coating method allows a large amount of paint to be coated on the workpiece under electrostatic attractive forces because the paint is easily atomized into small particles under centrifugal forces and the atomized particles are electrically charged.

As shown in FIG. 7 of the accompanying drawings, when an automobile body 11 is electrostatically coated, if narrow surfaces such as pillars 12 are coated under the same conditions as other flat surfaces, then the narrow surfaces may be overly coated, resulting in a loss of paint, and a paint dust may be applied, lowering the quality of the paint coating.

It has been proposed to control the pressure of shaping air for atomizing a paint from a rotary atomizing electrostatic coating apparatus for thereby adjusting the width of a coating pattern, as disclosed in Japanese patent publications Nos. 3-24266 and 7-24367. According to the disclosed processes, when the pressure of the shaping air is increased, the width of an electrostatic coating pattern, i.e., a sprayed field of paint particles, is reduced, for well coating narrow surfaces such as pillars 12.

However, when the pressure of the shaping air is increased, coated layers in gaps 13 around doors of the automobile body 11, a step 14 which defines a line on a side of the automobile body 11, and an opening 15 (see FIG. 8 of the accompanying drawings which shows at an enlarged scale an encircled area A in FIG. 7) tend to have an irregular thickness. If a metallic paint containing metallic particles or a pearl paint containing mica particles is used to electrostatically coat the automobile body 11, then those areas with irregularly coated layers have a different color than other areas.

According to an analysis made by the inventors, such a color difference is developed for the following reasons:

FIG. 9 of the accompanying drawings shows an electrostatic coating process which employs a metallic paint. As shown in FIG. 9, a rotary atomizing electrostatic coating apparatus 1 having a bell-shaped rotor 3 is positioned closely to a workpiece 2 to be coated. A metallic paint supplied into the bell-shaped rotor 3 is ejected as atomized fine particles from an outer peripheral edge 4 of the bell-shaped rotor 3 when the bell-shaped rotor 3 is in rotation.

When an area of the workpiece adjacent to the gap 13 or the opening as shown in FIG. 8 is coated, since there is no member which would shield the gap 13 and the opening 14 against the application of the ejected paint, the paint particles which are applied to the workpiece 2 enter the gap 13 without resistance, as shown in FIG. 9, at a speed higher than at the other surface of the workpiece 2.

Since the paint particles enter the gap 13 without resistance, more paint particles are applied to opposite edges of the gap 13 than to the other surface of the workpiece 2 as shown in FIG. 10 of the accompanying drawings. Therefore, a coated layer 16 is thicker at the opposite edges of the gap 13 than at the other surface of the workpiece 2. The thicker portions of the coated layer 16 contains more metallic particles 17 such as of aluminum which are arranged in a pattern different from those on the other surface of the workpiece 2. Such a different pattern of metallic particles 17 in the thicker portions of the coated layer 16 is liable to develop a color difference with the other surface of the workpiece 2. The inventors have found out that the color difference is more likely to develop as the pressure of the shaping air is higher.

SUMMARY OF THE INVENTION

It is an object of the present invention to provide an electrostatic coating method which is capable of coating a narrow area with a metallic paint, a pearl paint, or the like for excellent coating quality without developing a color difference.

Electrostatic coating processes are classified into a process which employs an electrically nonconductive solvent-type paint and a process which employs an electrically conductive water-soluble or aqueous paint. Electrostatic coating apparatus are also classified into an apparatus which applies a voltage to paint particles with an electrode that is positioned in the apparatus, i.e., an internal-voltage-application type, and an apparatus which applies a voltage to paint particles with an electrode that is positioned outside of the apparatus, i.e., an external-voltage-application type.

The inventors have made research efforts to achieve an electrostatic coating method which is capable of coating a narrow area for excellent coating quality without developing a color difference, and has found out that when a voltage applied to an internal-voltage-application-type rotary atomizing electrostatic coating apparatus while using an electrically conductive paint, a coated pattern width can be varied without increasing the pressure of shaping air, and the development of a dolor difference on a coated layer can be suppressed because the pressure of shaping air is not increased.

According to the present invention, there is provided a method of electrostatically coating a workpiece with an internal-voltage-application-type rotary atomizing electrostatic coating apparatus, comprising the steps of supplying an electrically conductive paint to the internal-voltage-application-type rotary atomizing electrostatic coating apparatus, and controlling a voltage applied to the internal-voltage-application-type rotary atomizing electrostatic coating apparatus depending on an area of the workpiece which is to be coated, for thereby varying a coated pattern width on the workpiece.

When the voltage applied to the internal-voltage-application-type rotary atomizing electrostatic coating apparatus is decreased, the coated pattern width is reduced. Consequently, though the pressure of shaping air is not increased, a narrow surface such as an automobile pillar can well be coated without a loss of paint and a deposition of paint dust, resulting in a good coating appearance free from color differences.

The electrically conductive paint may comprise a metallic paint, a pearl paint, or a solid paint insofar as it is a water-soluble paint or an aqueous paint.

The internal-voltage-application-type rotary atomizing electrostatic coating apparatus may comprise a rotary atomizing electrostatic coating apparatus as disclosed in U.S. Pat. No. 5,378,505, for example.

The paint pattern width is affected by the rotational speed of a bell-shaped rotor of the internal-voltage-application-type rotary atomizing electrostatic coating apparatus, the pressure, rate, speed, and direction of shaping air, and the rate at which the paint is ejected. The paint pattern width can be varied by controlling the voltage in a range from 20 KV to 70 KV, preferably from 40 KV to 60 KV. If the applied voltage were lower than 40 KV, then the efficiency of the coating process would be lowered. If the applied voltage were higher than 60 KV, then the quality of the coated layer would be unstable. The coated pattern width tends to be greater as the applied voltage is higher.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
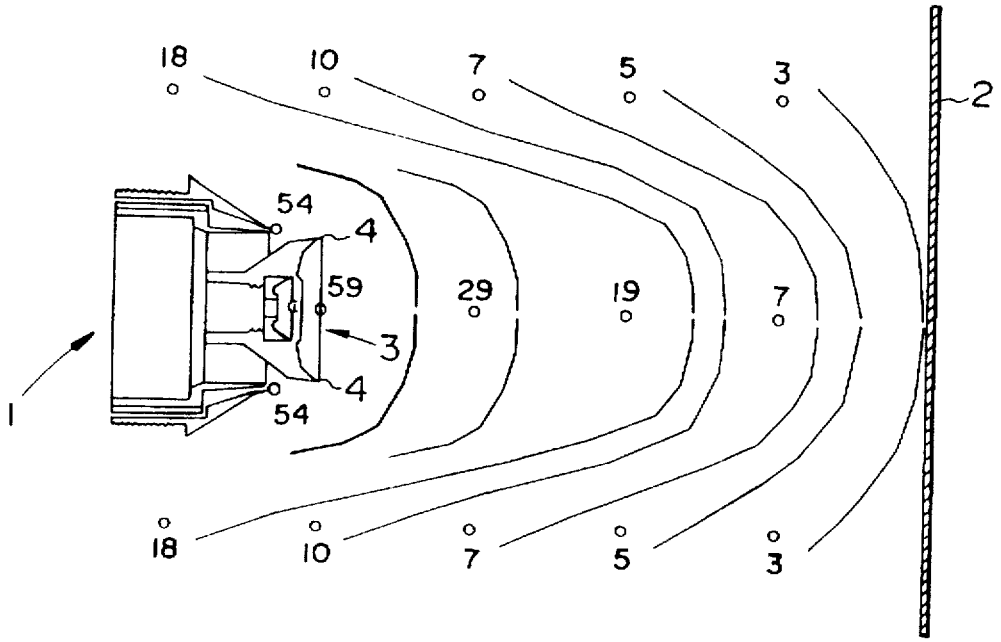
FIG. 1 is a view showing a potential distribution with an electrostatic coating method which is carried out by an internal-voltage-application-type rotary atomizing electrostatic coating apparatus.

An electrostatic coating method according to the present invention is carried out by an internal-voltage-application-type rotary atomizing electrostatic coating apparatus 1 shown in FIG. 1. In the electrostatic coating method, an applied voltage is controlled depending on an area of a workpiece 2 which is to be coated, for thereby varying the width of a coating pattern.

The internal-voltage-application-type rotary atomizing electrostatic coating apparatus 1 shown in FIG. 1 comprises an EGIIIW coating gun manufactured by Honda Engineering Co., Ltd. The internal-voltage-application-type rotary atomizing electrostatic coating apparatus 1 has a bell-shaped rotor 3 on its distal end for atomizing an electrically conductive paint such as a water-soluble paint, an aqueous paint, or the like supplied to an inner wall of the bell-shaped rotor 3, from an outer peripheral edge 4 under centrifugal forces generated upon rotation of the bell-shaped rotor 3, and ejecting the atomized paint particles toward the workpiece 2 on shaping air. At the same time, a high voltage is applied to the bell-shaped rotor 3 while it is in rotation to impart the voltage to the paint particles that are being ejected from the bell-shaped rotor 3.

The internal-voltage-application-type rotary atomizing electrostatic coating apparatus 1, which was spaced from the workpiece 2 by a distance of 200 mm, was supplied with an electrically conductive paint, i.e., a metallic paint "WT300 Silver Metallic" manufactured by Kansai Paint Co., Ltd., and a voltage of −60 KV was applied to the bell-shaped rotor 3 to electrostatically coat the workpiece 2. A potential distribution developed between the bell-shaped rotor 3 and the workpiece 2 when the workpiece 2 was thus electrostatically coated is shown in FIG. 1. The potential distribution was plotted by interconnecting points, shown as blank circular dots, where potentials around the electrostatic coating apparatus 1 are equal to each other. Numerical values at the points in FIG. 1 represent the magnitudes (KV) of potentials at the points.

The bell-shaped rotor 3 was rotated at 20000 r.p.m., the shaping air had a pressure of 1.3 kgf/cm$^2$, and the paint was ejected from the bell-shaped rotor 3 at a rate of 85 cc/min. It can be seen from FIG. 1 that the potential is progressively higher toward the rotational axis of the electrostatic coating apparatus 1 in the vicinity of the workpiece 1.

Figure 2:
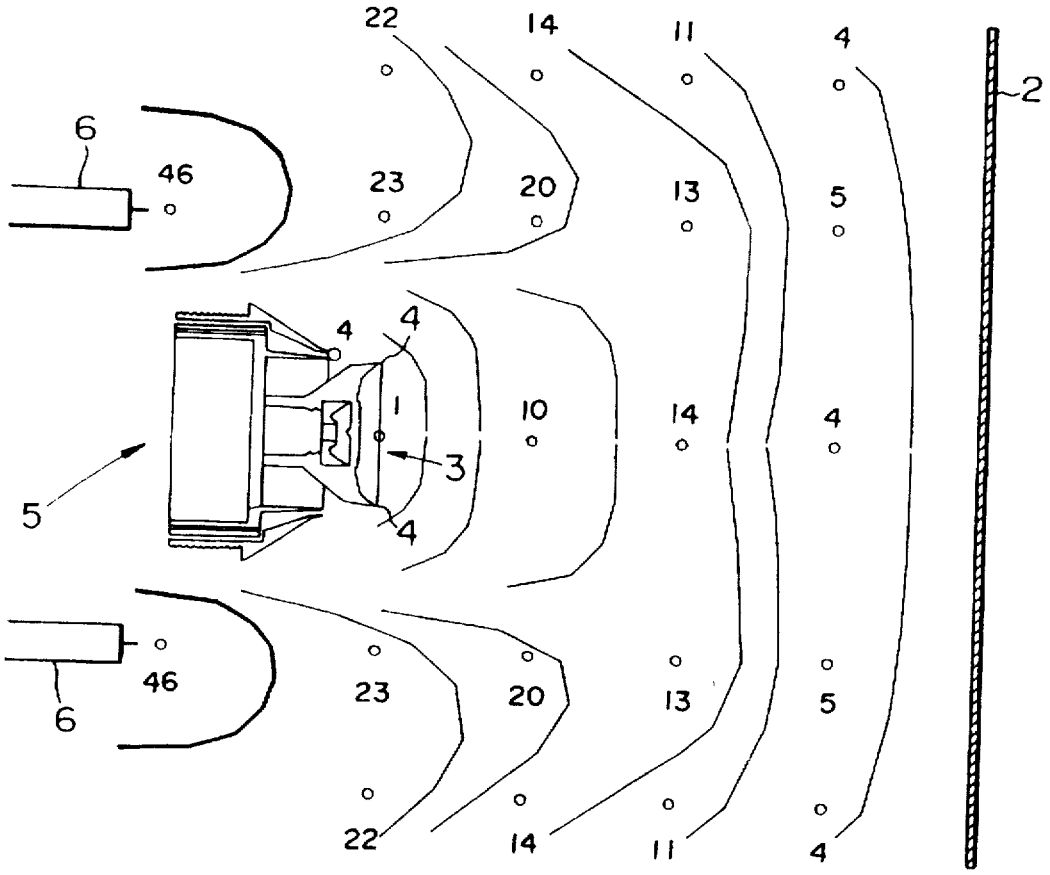
FIG. 2 is a view showing a potential distribution with an electrostatic coating method which is carried out by an external-voltage-application-type rotary atomizing electrostatic coating apparatus.

An electrostatic coating method according to the present invention is also carried out by an external-voltage-application-type rotary atomizing electrostatic coating apparatus 5 shown in FIG. 2. The external-voltage-application-type rotary atomizing electrostatic coating apparatus 5 shown in FIG. 2 comprises a COPES coating gun manufactured by ABB Landsburg Inc. The external-voltage-application-type rotary atomizing electrostatic coating apparatus 5 has a bell-shaped rotor 3 and an electrode 6 disposed around the bell-shaped rotor 3 for applying a voltage to paint particles that are ejected from the bell-shaped rotor 3 toward a workpiece 2. FIG. 2 shows a potential distribution developed between the bell-shaped rotor 3 and the workpiece 2 when the workpiece 2 was electrostatically coated under the same conditions as those of the electrostatic coating apparatus 1 shown in FIG. 1. It can be seen from FIG. 2 that points of equal potentials are distributed in a range which is progressively wider toward the workpiece 2.

A study of FIGS. 1 and 2 shows that the potential is progressively higher toward the rotational axis of the electrostatic coating apparatus 1 shown in FIG. 1 than toward the rotational axis of the electrostatic coating apparatus 5 shown in FIG. 2.

INVENTIVE EXAMPLE 1

Figure 3:
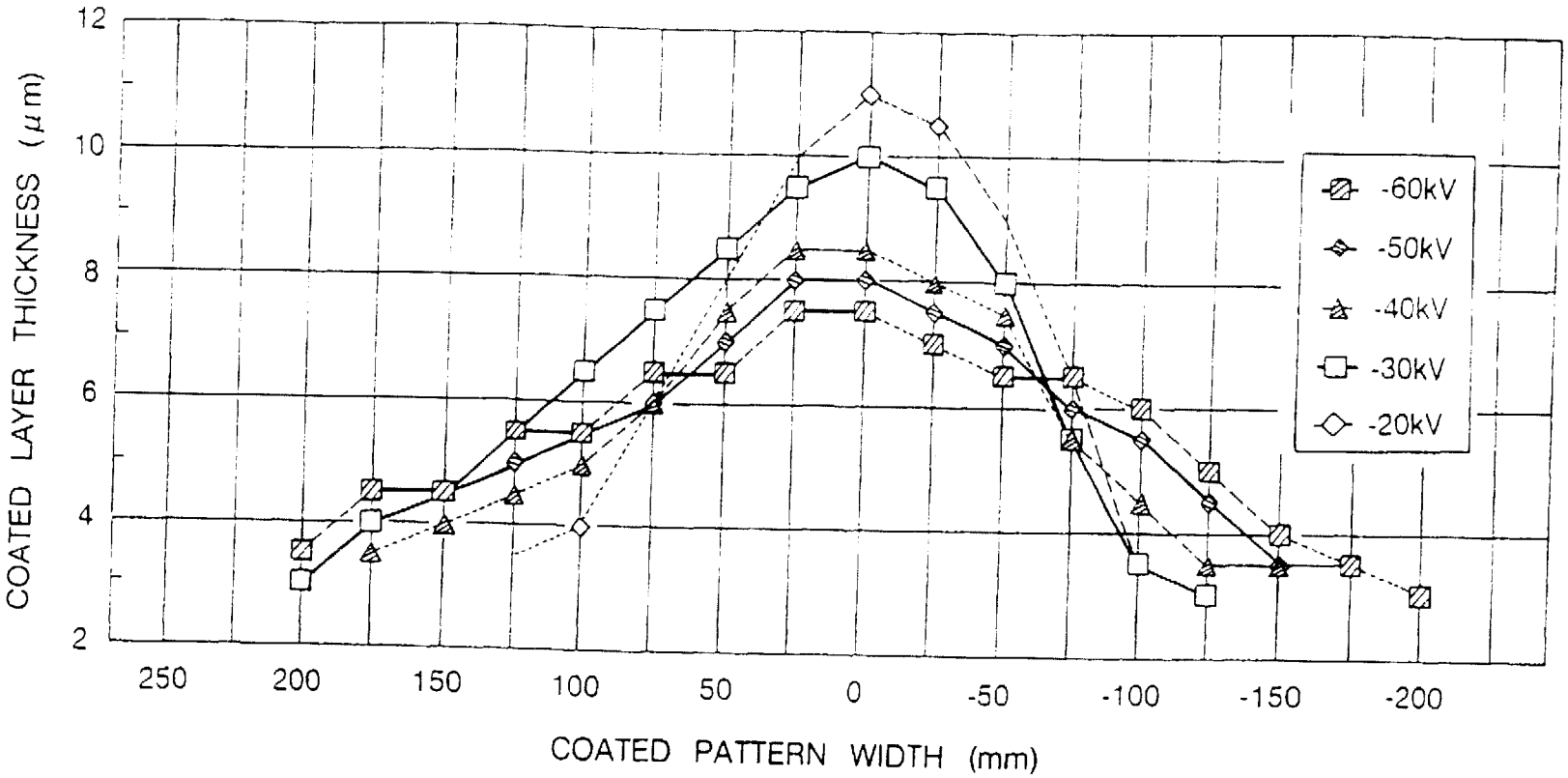
FIG. 3 is a graph showing the relationship between applied voltages and coated pattern widths in an example in which the electrostatic coating method was carried out using an electrically conductive paint.

The internal-voltage-application-type rotary atomizing electrostatic coating apparatus 1 was supplied with an electrically conductive metallic paint "WT300 Silver Metallic" manufactured by Kansai Paint Co., Ltd., and the workpiece 2 was coated under different applied voltages. FIG. 3 shows the relationship between applied voltages and coated pattern widths in Inventive Example 1.

The graph shown in FIG. 3 has an origin at a position on the workpiece 2 (see FIG. 1) which is aligned with the rotational axis of the electrostatic coating apparatus 1. The coated pattern widths are represented by distances (mm) from the origin, which are positive on the left-hand side of the origin, and negative on the right-hand side of the origin. FIG. 3 also shows coated layer thicknesses (μm) which were formed at the respective distances under the different voltages. The conditions other than the applied voltages were the same as those of FIG. 1.

INVENTIVE EXAMPLE 2

Figure 4:
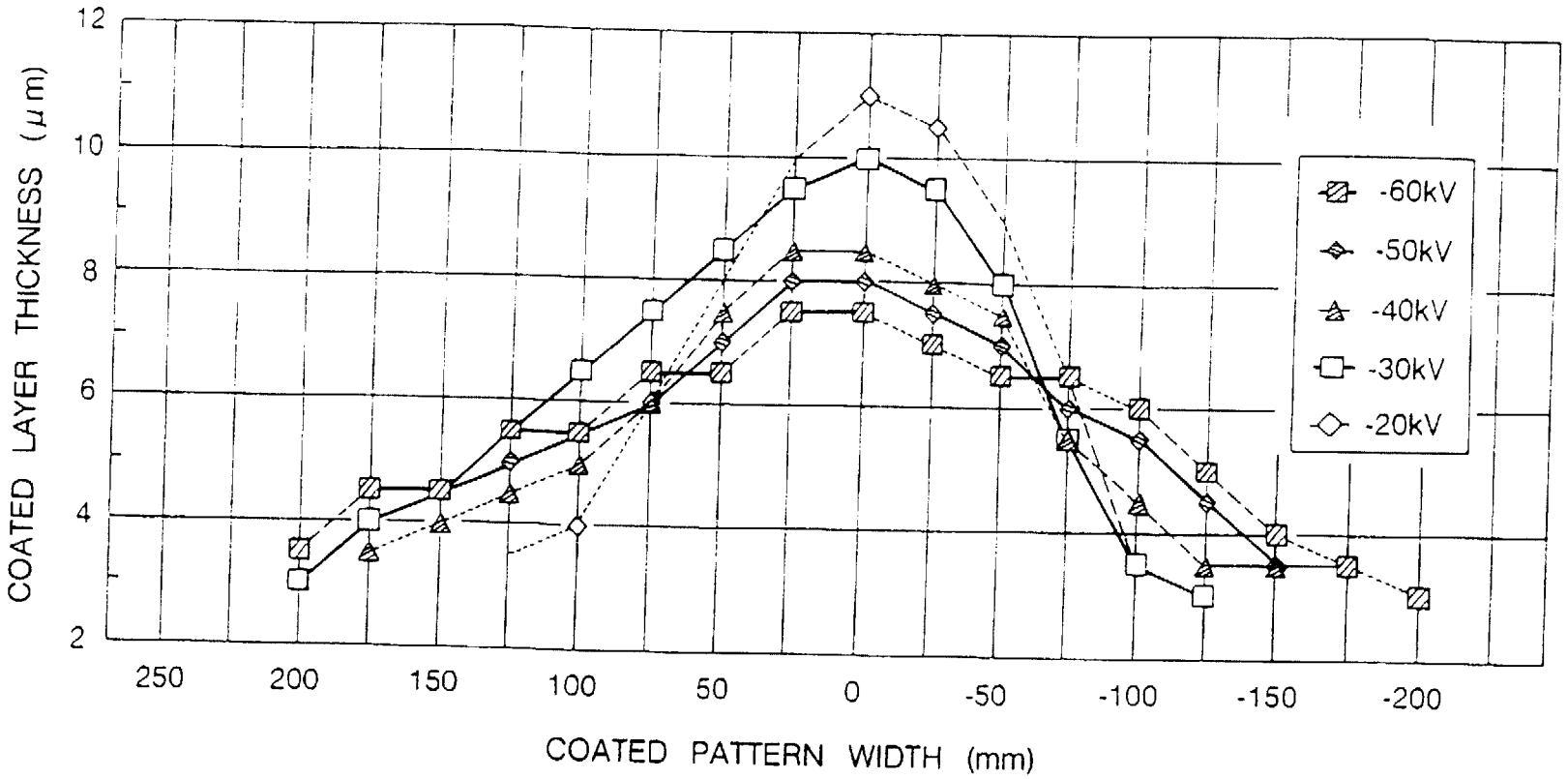
FIG. 4 is a graph showing the relationship between applied voltages and coated pattern widths in another example in which the electrostatic coating method was carried out using an electrically conductive paint.

The internal-voltage-application-type rotary atomizing electrostatic coating apparatus 1 was supplied with an electrically conductive pearl paint "WT500 Red Pearl" manufactured by Kansai Paint Co., Ltd., and the workpiece 2 was coated under different applied voltages. FIG. 4 shows the relationship between applied voltages and coated pattern widths in Inventive Example 2.

INVENTIVE EXAMPLE 3

Figure 5:
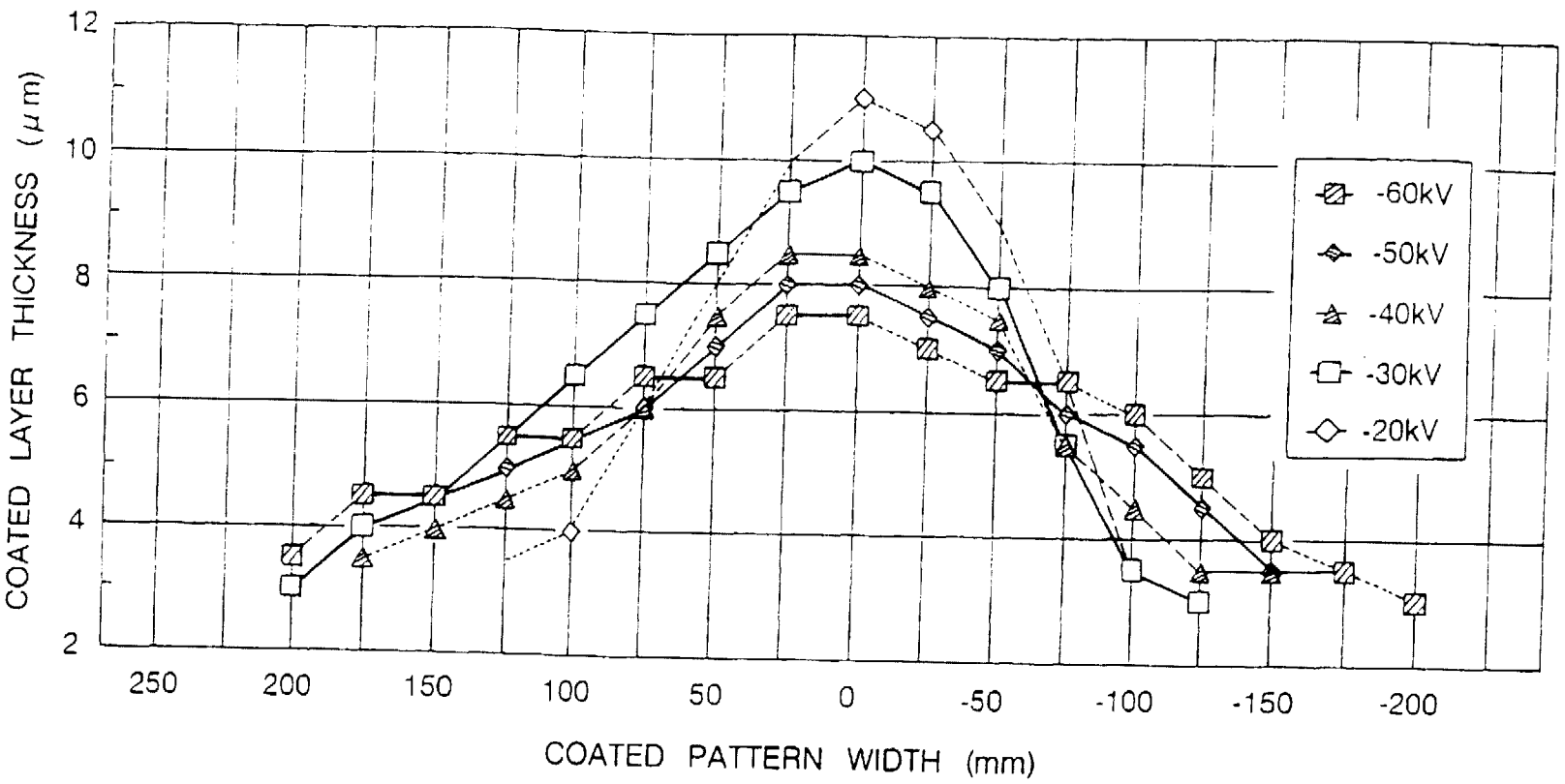
FIG. 5 is a graph showing the relationship between applied voltages and coated pattern widths in still another example in which the electrostatic coating method was carried out using an electrically conductive paint.

The internal-voltage-application-type rotary atomizing electrostatic coating apparatus 1 was supplied with an electrically conductive solid paint "WT330 Silver (Solid)" manufactured by Kansai Paint Co., Ltd., and the workpiece 2 was coated under different applied voltages. FIG. 5 shows the relationship between applied voltages and coated pattern widths in Inventive Example 3.

It can be understood from FIGS. 3 through 5 that, with the internal-voltage-application-type rotary atomizing electrostatic coating apparatus 1, the coated pattern width can be increased by increasing the applied voltage, and hence the coated pattern width can be varied by controlling the applied voltage.

COMPARATIVE EXAMPLE 1

Figure 6:
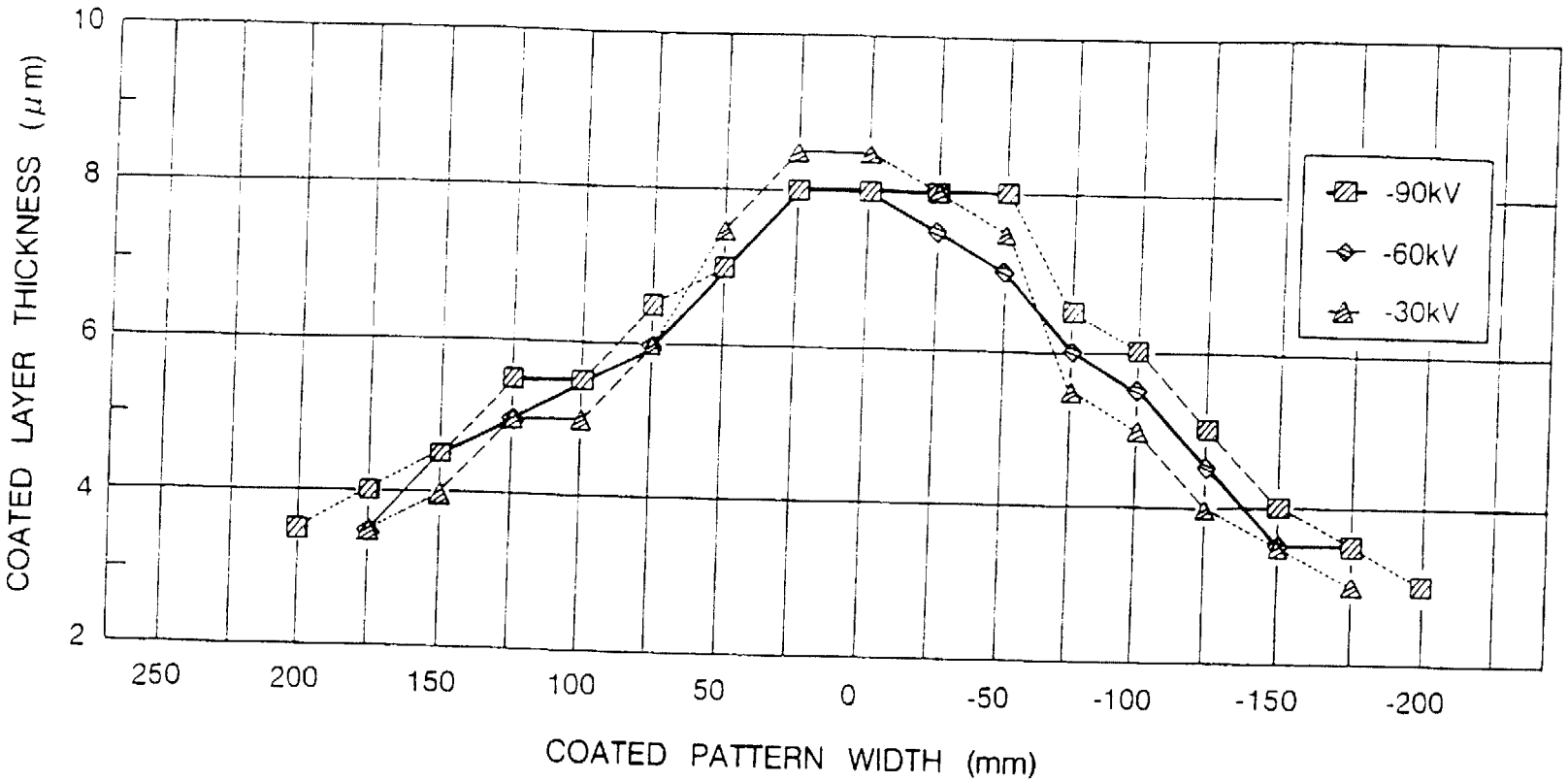
FIG. 6 is a graph showing the relationship between applied voltages and coated pattern widths in an example in which the electrostatic coating method was carried out using an electrically nonconductive paint.
Figure 7:
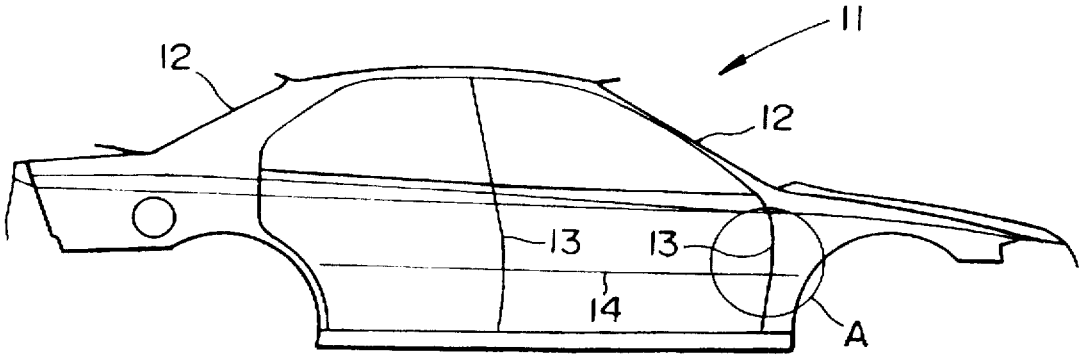
FIG. 7 is a schematic side elevational view of an automobile body.
Figure 8:
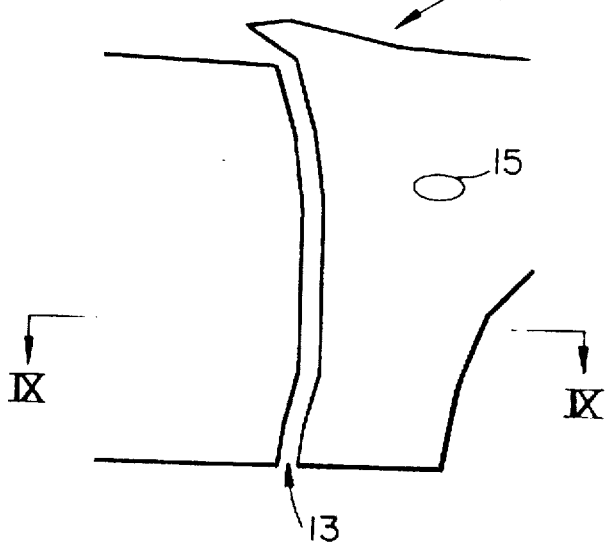
FIG. 8 is an enlarged fragmentary view showing an encircled area A in FIG. 7.
Figure 9:
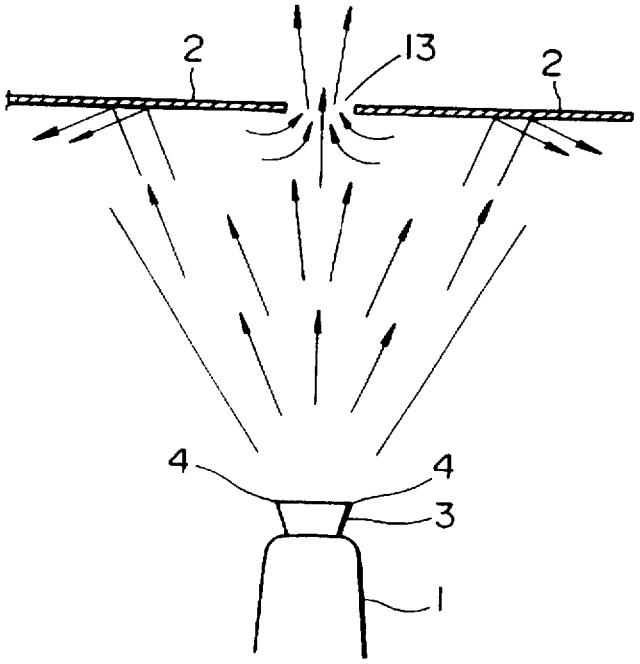
FIG. 9 is a fragmentary cross-sectional view taken along line IX—IX of FIG. 8.
Figure 10:
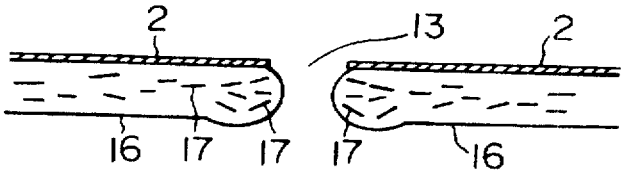
FIG. 10 is a fragmentary cross-sectional view of a coated layer produced by an electrostatic coating process shown in FIG. 9.

The internal-voltage-application-type rotary atomizing electrostatic coating apparatus 1 was supplied with an electrically nonconductive solvent-type metallic paint "HM22 Silver Metallic" manufactured by Kansai Paint Co., Ltd., and the workpiece 2 was coated under different applied voltages. FIG. 6 shows the relationship between applied voltages and coated pattern widths in Comparative Example 1. The conditions other than the applied voltages were the same as those of FIG. 1. A review of FIG. 6 indicates that the ability to vary the coated pattern width by varying the applied voltage is not clearly seen with the electrically non-conductive paint.

Therefore, the electrostatically coating method according to the present invention can be carried out using the electrically conductive paint as can be seen from FIGS. 3 through 6.

In the electrostatically coating method according to the present invention, it is preferable to rotate the bell-shaped rotor 3 of the internal-voltage-application-type rotary atomizing electrostatic coating apparatus 1 shown in FIG. 1 at a constant rotational speed in order to uniformize the diameters of the ejected paint particles. The pressure of the shaping air should also preferably be constant, but may vary insofar as any color difference which would result in a poor appearance will not be produced on the coated layer.

Although certain preferred embodiments of the present invention have been shown and described in detail, it should be understood that various changes and modifications may be made therein without departing from the scope of the appended claims.

What is claimed is:

1. A method of electrostatically coating a workpiece with an internal-voltage-application rotary atomizing electrostatic coating apparatus, comprising the steps of:

providing an internal-voltage-application rotary atomizing electrostatic coating apparatus having a rotatable rotor;

supplying an electrically conductive paint to the internal-voltage-application rotary atomizing electrostatic coating apparatus;

applying a voltage to the rotor to impart a charge to the electrically conductive paint; and varying the voltage applied to the rotor to change the electrically conductive paint being ejected from the rotor depending on an area of the workpiece which is to be coated, for thereby varying a coated pattern width of the electrically conductive paint coated on the workpiece.

2. The method according to claim 1, wherein said voltage is controlled in a range from 20 KV to 70 KV.

3. The method according to claim 1, wherein said voltage is controlled in a range from 40 KV to 60 KV.

4. The method according to claim 1, wherein said rotor is rotated at a constant rotational speed.

5. The method according to claim 1, wherein said workpiece is one of a pillar, a gap around doors, a step defining a sideline and an opening of an automobile body.

6. The method according to claim 2, wherein a shaping air is supplied, and a pressure of the shaping air is constant.

7. The method according to claim 3, wherein a shaping air is supplied, and a pressure of the shaping air is constant.

8. A method of electrostatically coating a workpiece with an internal-voltage-application rotary atomizing electrostatic coating apparatus, comprising the steps of:

supplying an electrically conductive paint to the internal-voltage-application rotary atomizing electrostatic coating apparatus; and varying a voltage applied to the internal-voltage-application rotary atomizing electrostatic coating apparatus depending on an area of the workpiece which is to be coated, for thereby varying a coated pattern width of the electrically conductive paint coated on the workpiece, wherein said voltage is controlled in a range from 40 KV to 60 KV, wherein a shaping air is supplied, and a pressure of the shaping air is constant.

* * * * *